US005605133A

United States Patent [19]

Tuckey

[11] Patent Number: 5,605,133

[45] Date of Patent: Feb. 25, 1997

[54] FUEL RAIL PRESSURE CONTROL

[75] Inventor: Charles H. Tuckey, Cass City, Mich.

[73] Assignee: Walbro Corporation, Cass City, Mich.

[21] Appl. No.: 560,150

[22] Filed: Nov. 20, 1995

[51] Int. Cl.[6] ..... F02M 37/04; F02M 41/00

[52] U.S. Cl. ..... 123/458; 123/464; 123/511

[58] Field of Search ..... 123/458, 463, 123/464, 509, 516, 514, 510, 511

[56] References Cited

U.S. PATENT DOCUMENTS

| | | | |
|---|---|---|---|
| 4,635,606 | 1/1987 | Koike et al. | 123/459 |
| 4,829,964 | 3/1989 | Asayama | 123/463 |
| 5,133,323 | 7/1992 | Treusch | 123/463 |
| 5,265,644 | 11/1993 | Tuckey | 123/463 |
| 5,289,810 | 3/1994 | Bauer et al. | 123/514 |
| 5,381,816 | 1/1995 | Alsobrooks et al. | 123/463 |
| 5,398,655 | 3/1995 | Tuckey | 123/514 |
| 5,458,104 | 10/1995 | Tuckey | 123/463 |

*Primary Examiner*—Thomas N. Moulis

*Attorney, Agent, or Firm*—Barnes, Kisselle, Raisch, Choate, Whittemore & Hulbert

[57] ABSTRACT

A no-return fuel system with a pressure regulator controlling the pressure of fuel supplied by a pump to the fuel rail and injectors of an internal combustion engine. The regulator has a bypass valve movable to open and closed positions by a diaphragm assembly to regulate the pressure of fuel supplied to the engine. The diaphragm is responsive to the pressure of fuel in a sensor line connected to the supply of fuel to the engine downstream of the bypass valve. To increase the pressure of fuel supplied to the engine when the pump is operating under an engine hot soak temperature conditions, a bleed passage communicating with the sensor line is opened by a solenoid actuated valve energized by a temperature responsive switch adjacent the engine.

10 Claims, 2 Drawing Sheets

FUEL RAIL PRESSURE CONTROL

FIELD OF THE INVENTION

This invention relates to automotive fuel supply systems and more particularly to a fuel pressure regulator for a no-return fuel system for an engine with fuel injectors.

BACKGROUND OF THE INVENTION

Some automotive vehicle internal combustion engines with fuel injectors utilize a no-return fuel system. In such a system, fuel is typically supplied to one or more fuel rails or distribution manifolds communicating with each fuel injector and no fuel is returned from the fuel rails downstream of any of the fuel injectors. Typically, in a no-return system, fuel is supplied by an electric pump received in the fuel tank to the fuel rail through one or more pressure regulators to supply fuel to the injectors at a substantially constant pressure relative to either the atmosphere or at a substantially constant pressure drop across the operating injectors and hence relative to the absolute pressure in the air intake manifold. Usually, when the engine is running, pressure in the intake manifold downstream of a throttle valve is subatmospheric although in supercharged engines, it may be superatmospheric.

Normally, when a vehicle operator turns off the ignition of an engine, the engine fuel rail remains full of liquid fuel and often a check valve in the system downstream of the pump outlet and upstream of the fuel rail prevents liquid fuel from returning through the pump or otherwise to the fuel tank. Under normal conditions of ambient temperature, all of the fuel in the rail remains in liquid form and upon cranking to restart the engine liquid fuel is immediately available to the engine. However, under certain hot weather or engine overheating conditions, usually referred as "hot soak" conditions, the temperature of fuel in the rail can increase sufficiently for part of the fuel to vapororize and form fuel vapor therein. If it is attempted to start the engine under these hot soak conditions, it will stall, stumble or at best run extremely roughly at a very low speed until all the vaporized fuel in the rail has been consumed and only liquid fuel is again supplied to all of the injectors. Usually, hot soak conditions producing fuel vapor in the rail occur when the engine is shut off although they sometimes occur when the engine is running. Sometimes, the temperature of fuel in the rail and in the surrounding engine compartment can become as high as about 250° F. and even fuel in the tank can reach a temperature as high as about 125°–130° F.

SUMMARY OF THE INVENTION

A pressure regulator for a no-return system which when the fuel pump is running supplies fuel to the rail at a first operating pressure under normal temperatures conditions and under hot soak temperature conditions at a sufficiently higher second pressure to avoid vaporized fuel being supplied to the fuel injectors. When connected to an operating fuel pump, the device regulates the pressure of liquid fuel supplied to the fuel injectors by actuating a valve to bypass a portion of fuel supplied from the pump. The valve is opened and closed by a diaphragm actuated by and responsive to the pressure of the fuel supplied to the fuel injectors. Under hot soak or high temperatures conditions, a portion of the fuel acting on the diaphragm is bled off or bypassed, preferably by a orifice and a solenoid actuated control valve, to reduce the pressure of fuel actuating on the diaphragm and thereby increase the pressure of fuel supplied by the pump to the fuel injectors. Under hot soak conditions, the pressure of fuel supplied to the injectors is increased sufficiently to avoid vaporization and thereby insure that liquid fuel is supplied to the fuel injectors.

Objects, features and advantages of this invention include providing a pressure regulator for a no-return fuel system which avoids fuel vapor being supplied to an operating engine under hot soak conditions, stalling, stumbling and rough running upon startup of the engine under hot soak conditions, and is rugged, durable, stable, reliable, of relatively simple design, economical manufacture and assembly and in service has a long useful life.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE INVENTION

Figure 1:
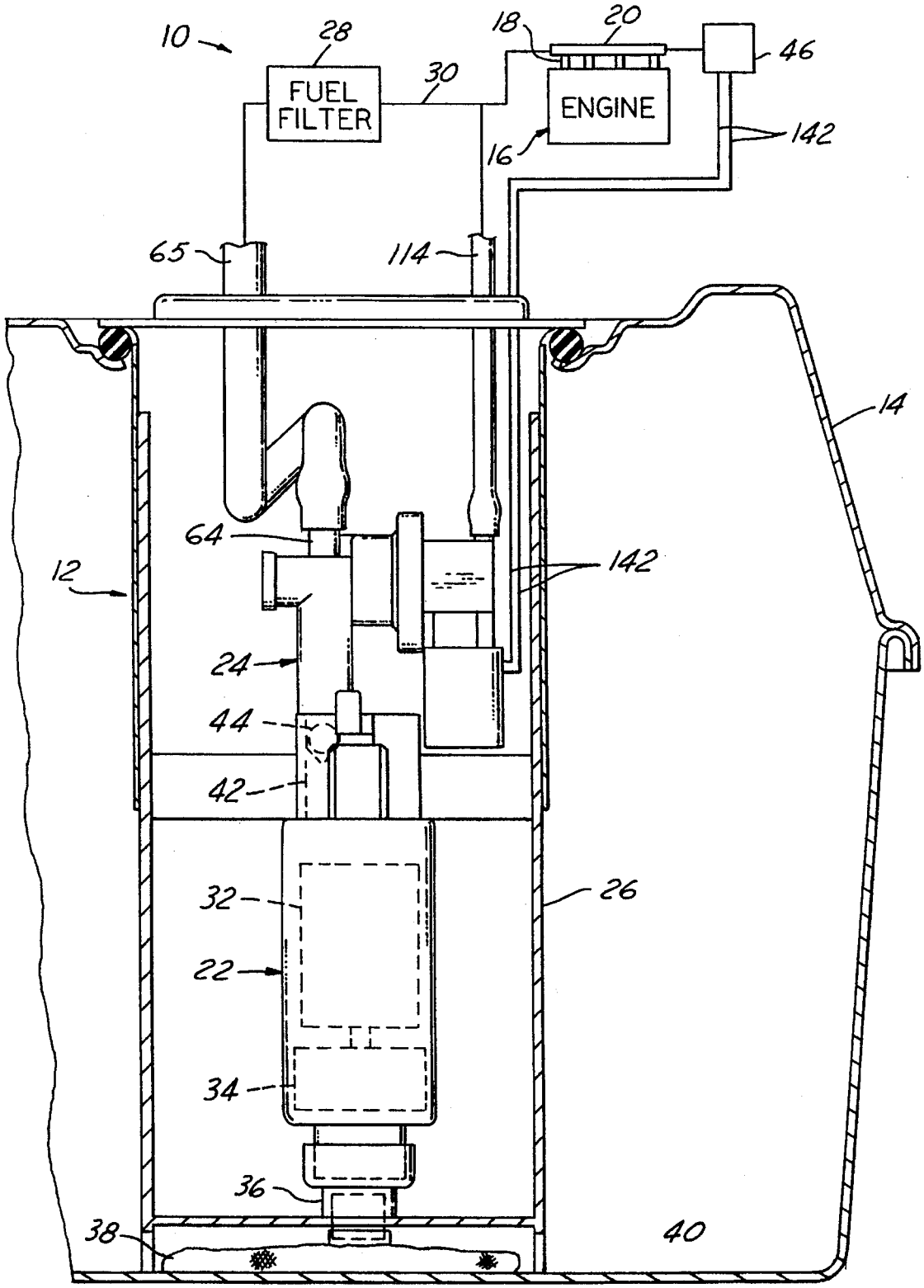
FIG. 1 is a semi-diagrammatic view of a pressure regulator embodying this invention disposed in a fuel pump module received in a fuel tank for an automotive vehicle for supplying fuel to the fuel injectors of an engine.

FIG. 1 illustrates an automotive no-return fuel system 10 with a fuel pump module 12 received in a fuel tank 14 for supplying liquid fuel to an internal combustion engine 16 with a plurality of fuel injectors 18 connected to a fuel rail 20 for supplying fuel to the injectors. In operation, no fuel is returned from the rail 20 downstream from any or all of the fuel injectors and hence this is commonly referred to as a no-return or returnless fuel system. The module has an electric fuel pump assembly 22 and a pressure regulator 24 embodying this invention disposed in a canister 26 mounted in the fuel tank 14 for supplying liquid fuel through a filter 28 and a line 30 to the rail 20 of the engine. The filter 28 may be located outside of the tank or in some applications it is received in the module. The pump asembly has an electric motor 32 which drives a fuel pump 34 with an inlet 36 connected to a fuel filter 38 lying on the bottom 40 of the tank and a fuel outlet 42 connected to the inlet of the pressure regulator preferably through a check valve 44 which prevents reverse flow through the pump. To sense when a hot soak or high fuel temperature condition exists, a temperature responsive switch 46 is mounted in the engine compartment, usually adjacent the engine and preferably adjacent, on, or in the fuel rail or fuel supply conduit immediately adjacent the fuel rail.

Figure 2:
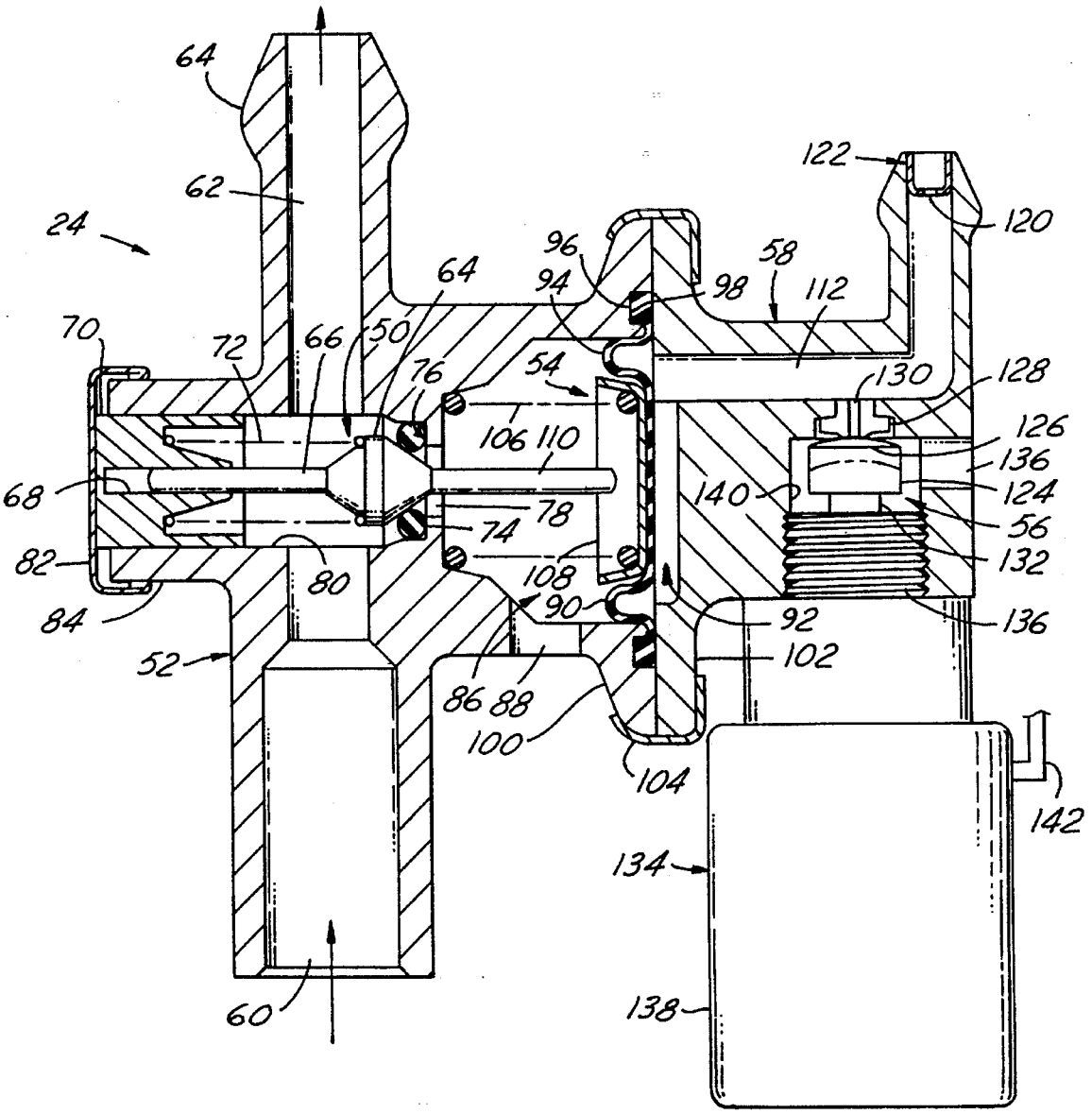
FIG. 2 is a sectional view of the pressure regulator of FIG. 1.

As shown in FIG. 2, the pressure regulator 24 has a bypass valve assembly 50 mounted in a housing 52 actuated by a diaphragm assembly 54 which is responsive to the pressure of fuel supplied to the fuel injectors. A solenoid actuated valve assembly 56 is mounted in a housing 58 and associated with the diaphragm assembly to increase the pressure of fuel supplied by the operating pump to the fuel injectors under hot soak conditions in response to actuation by the temperature sensing switch 46.

The housing 52 has a fuel inlet 60 which communicates with the outlet 42 of the fuel pump and a fuel outlet passage 62 opening through a hose connector 64 which is connected to the filter 28 by a hose or line 65. The valve assembly 50 has a conical valve head 64 fixed to a guide stem 66 slidably received in a bore 68 in a plug 70 and yieldably biased by a compression spring 72 received between them into engagement with a seat in the form of an O-ring 74 received on a shoulder 76 formed by a bore 78 and a counterbore 80 in the housing. To permit adjustment of the pressure of fuel supplied to the engine under normal temperature conditions, the plug 70 is slidably received in the counterbore 80 in the housing and axially movable by an adjustment cap 82 threaded or frictionally retained on a protuberance 84 of the housing. When the valve is open, it communicates the outlet passage 62 with a cavity 86 and a discharge port 88 for bypassing a portion of the fuel from the pump back to the fuel tank.

The valve 50 is actuated by the diaphragm assembly 54 which has a flexible diaphragm 90 overlying a chamber 92 in the housing 58 and having a convolution 94 and a peripheral annular rib 96 received in a groove 98 and clamped and sealed between confronting flanges 100 & 102 of the housings by a clamp ring 104 spun over the flanges. The diaphragm 90 is yieldably biased toward the chamber by a compression spring 106 received in the cavity with one end bearing on the housing 52 and the other end received in a protective cup 108 bearing on the diaphragm. When the diaphragm 90 is sufficiently displaced against the bias of the spring 106, it engages the free end of an actuator stem 110 fixed to the valve 50 to displace the valve from its seat 74 and thereby open it.

Downstream of the valve assembly 50, the diaphragm chamber 92 communicates with the fuel supplied to the fuel injectors through a passage 112 in the housing 58 connected to the chamber. As shown in FIG. 1, the chamber 92 communicates with fuel supplied to the engine through a hose 114 connected to the line 30 at a point downstream of the filter fuel 28 and upstream of the engine fuel rail 20 to insure that the pressure of fuel supplied to the engine is not adversely affected by partial filling or plugging of the fuel filter in use. However, in use, the hose 114 could be connected upstream of the filter 28 or it could be eliminated and the diaphragm chamber 92 connected with the outlet passage 62 downstream of the valve assembly 50 by providing a passage in the housing.

When the pump 22 is operating, the pressure of fuel in the chamber 92 acting on the diaphragm 90 can be reduced by the cooperation of the solenoid valve assembly 56 and upstream thereof a restricted orifice 120 in an insert 122 press fit in the passage. The solenoid valve assembly 56 has a valve head 124 yieldably biased into engagement with a seat 126 on an insert 128 received in the housing 58 and having an orifice 130 communicating with the passage 112 downstream of the restricted orifice 120. The valve head 124 is carried by a plunger 132 of a solenoid 134 and is yieldably biased to its closed position, as shown in FIG. 2, by a spring in the solenoid and retracted to an open position spaced from the seat 126 when the solenoid is energized. When the valve 5 6 i s open, fuel i s bled through the passage 130 to reduce the pressure of the fuel acting on the diaphragm 90 and flows through a port 136 in the housing back to the fuel tank.

The solenoid 134 is mounted on the housing 58 by a neck 136 of its case 138 being threaded into a counterbore 140 in the housing. The coil of the solenoid is connected by lead wires 142 with a power source, such as battery and electrical system of an automobile, by actuation of the temperature responsive switch 46 when it closes to energize the solenoid coil under hot soak temperature conditions when the vehicle ignition system is turned on.

Operation

In operation of the fuel system 10, when the pump assembly 22 is energized it supplies fuel to the fuel rail 20 and injectors 18 of the engine 16 through the pressure regulator 24, fuel filter 28 and interconnecting lines 65 & 30. The pressure of the fuel downstream of the filter 28 is sensed by and acts on the diaphragm 90 through the chamber 92 and interconnecting passage 112 and fuel line 114. The pressure of fuel in the chamber 92 moves the diaphragm against the bias of the spring 106 to bear on the actuator 110 and open the valve 50 to bypass a portion of the fuel supplied by the pump from the passage 62 through the chamber 86 and port 88 to the tank and thereby maintain a substantially constant predetermined pressure, such as 40 psig, of the fuel supplied to the fuel rail 20 and injectors 18 of the engine. Under steady state engine and regulator operating conditions, the valve 50 and diaphragm 54 assemblies would stabilize in some partially open position. However, under normal dynamic engine operating conditions, the valve and diaphragm are believed to hunt, oscillate, or move rapidly toward open and closed positions to maintain a substantially constant fuel pressure of the fuel supplied to the fuel rail 20 and injectors 18 of the engine. The desired normal operating pressure can be adjusted within limits by turning the knob 82 to axially displace the plug 70 and thereby change the force produced by the spring 72 on the valve assembly 50 which tends to close it.

Also, if the pump 22 is operating and there is a hot soak temperatrure condition, the temperature responsive switch 46 will be closed to energize the solenoid 134 to open the bleed valve assembly 56. While the bleed valve assembly 56 is open, fuel will be bled from the passage 112 thereby reducing the pressure of the fuel acting on the diaphragm 90 which will cause the pressure regulator 24 to deliver fuel at a higher pressure to the fuel rail 20 and injectors 18 of the engine. By properly calibrating the size of the bleed port 130 in relation to the size of the restricted orifice 120, the pressure of the fuel acting on the diaphragm 90 will be reduced sufficiently to cause the operating pump 22 to supply fuel to the rail at a sufficiently increased pressure, such as 55–65 p.s.i. to prevent the fuel in the rail from vaporizing at elevated fuel temperatures occurring under hot soak conditions which may be up to about 250° F. The temperature responsive switch 46 may be designed and calibrated to close and energize the solenoid 134 at a fuel temperature in the rail (such as 150° F.) below that at which the fuel would vaporize under the normal operating pressure such as 40 psig.

If the engine and ignition system is turned off and hence the fuel pump 22 is not operating, and hot soak conditions occur, fuel vapor will usually develop in the fuel rail. If, under these conditions, the ignition system is turned on preparatory to starting the engine, both the fuel pump 22 and the solenoid 134 will be energized to cause the pump to supply fuel to the rail at the higher pressure of 55 to 65 psig, which will cause any fuel vapor in the rail to be sufficiently pressurized to return to liquid form within a matter of few seconds or less, so that when the engine is cranked and started, it will be supplied with only liquid fuel and will run smoothly without any stumbling, stalling or rough idling which would otherwise occur if fuel vapor were present due to fuel being initially supplied at the lower normal operating pressure (such as 40 psig ) while the hot soak condition exists.

Therefore, the pressure regulator and system insures that only liquid fuel is supplied for starting and operation of the engine under both hot soak and normal temperature operating conditions of the engine.

What is claimed is:

1. A no-return fuel system for an internal combustion engine which comprises:

(a) a fuel pump, (b) a main fuel line connecting the fuel pump and the engine, (c) a pressure regulator valve in the main fuel line operable when open to bypass fuel upon pressure in the main fuel line reaching a predetermined value, a diaphragm controlling the open and closed positions of said valve, (d) a line connecting one side of the diaphragm with the main fuel line downsteam of the fuel pump and upstream of the engine, (e) a normally closed bypass valve in the line, and (f) a temperature responsive means adjacent the engine and operably associated with the bypass valve to open the bypass valve upon the temperature exceeding a set point to actuate the diaphragm to increase the pressure in the main fuel line to prevent vaporization of fuel in the main fuel line from reaching the engine.

2. A no-return fuel system for an internal combustion engine which comprises;

(a) a fuel pump, (b) a main fuel line connecting the fuel pump and the engine, (c) a pressure regulator valve in the main fuel line operable when open to bypass fuel upon pressure in the main fuel line reaching a predetermined value, a diaphragm controlling the open and closed positions of said valve, a spring means on one side of said diaphragm biasing said diaphragm to a closed position of said valve, (d) a pressure sensor line connecting said main fuel line to the other side of said diaphragm to urge said diaphragm toward an open position of said valve, (e) a temperature responsive means adjacent the engine and operably associated with the regulator valve to increase the pressure in the main fuel line upon the temperature exceeding a set point, and (f) a bypass valve in said sensor line responsive to said temperature responsive means to relieve pressure in said sensor line and cause said regulator valve to increase the pressure in the main line to prevent vaporization of fuel in the main fuel line from reaching the engine.

3. The fuel system as defined in claim 2 which also comprises a solenoid operably connected with said bypass valve, and a temperature responsive switch adjacent the engine to operate said solenoid and open said bypass valve upon the temperature exceeding a set point at said engine.

4. A no-return fuel system for an internal combustion engine which comprises:

(a) a main fuel line connecting a fuel pump with a fuel rail of an engine, (b) a pressure regulator in the main fuel line including a spring-biased diaphragm-controlled valve operable when opened to dump fuel from the main fuel line upon reaching a predetermined value, (c) a pressure sensor line originating downstream of the diaphragm-controlled valve and upstream of the engine and in communication with one side of the diaphragm opposed to the spring bias, (d) a bypass valve in the pressure sensor line, (e) a solenoid associated with the bypass valve to open the bypass valve when actuated, and (f) a temperature responsive switch adjacent the engine to actuate said solenoid upon the temperature at the switch exceeding a predetermined setting.

5. A no-return fuel system for an internal combustion engine which comprises:

(a) a fuel tank, (b) a fuel canister supported in the main fuel tank, (c) a fuel pump in the canister having a fuel inlet adjacent the bottom of the tank and a fuel outlet passage leading to the engine, (d) a control housing in the canister having a through fuel passage connected at one end to said pump outlet and at the other end to an engine, (e) a regulator first bypass port in said housing open to said canister, (f) a pressure regulator valve between said fuel passage and said first bypass port, (g) means biasing said regulator valve to a closed position, (h) a diaphragm in said control housing positioned to urge said regulator valve to an open position, (i) a fuel pressure sensor line connecting a side of said diaphragm and the fuel outlet passage downstream of the pressure regulator valve, (j) a second bleed port in said control housing open to said canister and in communication with said fuel pressure sensor line, (k) a second valve between said second bleed port and said fuel pressure sensor line, (l) a solenoid operatively connected to said second valve to open and close said second bleed port, and (m) a temperature responsive switch adjacent said engine operable to activate said solenoid to open said second bleed port upon temperature exceeding a pre-set point at said engine.

6. A fuel system as defined in claim 5 in which a fuel filter is interposed in said fuel outlet passage downstream from said pressure regulator valve, and said fuel pressure sensor line is connected to said fuel outlet passage between said filter and the engine.

7. A pressure regulator for a no-return fuel system for an internal combustion engine with fuel injectors comprising, a housing having a fuel passage with an inlet constructed for receiving fuel under pressure from a fuel pump and an outlet for supplying fuel to the injectors of an engine, a bypass port communicating with the fuel passage and opening to the exterior of the housing, a pressure regulator valve communicating with the bypass port and movable to open and closed positions to control the flow of fuel through the bypass port, a diaphragm carried by the housing and constructed to move and actuate the valve to open and closed positions, a fuel pressure sensor line communicating with one side of the diaphragm and the fuel passage downstream of the pressure regulator valve, a bleed passage communicating with the one side of the diaphragm to bleed off fuel from the fuel pressure sensor line, a control valve connected to the bleed passage and movable to open and closed positions to control the flow of fuel through the bleed passage, and a solenoid operably connected with the control valve to open the bleed passage when energized in response to a hot soak engine temperature condition existing at least while a fuel pump is operating to supply fuel through the regulator pressure to the engine.

8. The regulator of claim 7 which also comprises a spring yieldably biasing the diaphragm toward a closed position of the regulator valve.

9. The regulator of claim 7 which also comprises a first spring yieldably biasing the regulator valve toward its closed position, and a second spring yieldably biasing the diaphragm toward a closed position of the regulator valve.

10. The regulator of claim 7 which also comprises, a spring yieldably biasing the regulator valve toward its closed position and a member carried by the housing and movable generally axially relative to the spring to vary and adjust the force with which the spring yieldably urges the regulator valve toward its closed position.

* * * * *